United States Patent [19]

Bradley

[11] Patent Number: 4,993,166

[45] Date of Patent: Feb. 19, 1991

[54] ADJUSTABLE PIN GUIDE FOR USE IN SCREEN PRINTING

[76] Inventor: Carlos Bradley, 418 First Ave. E., Kalispell, Mont. 59901

[21] Appl. No.: 335,853

[22] Filed: Apr. 10, 1989

[51] Int. Cl.[5] ..... B05C 17/08

[52] U.S. Cl. ..... 33/619; 101/DIG. 36; 101/127.1

[58] Field of Search ..... 101/126, 127, 127.1, 101/129, 481, 485, 486, DIG. 36; 33/614, 617, 619, 620, 621

[56] References Cited

U.S. PATENT DOCUMENTS

| | | | |
|---|---|---|---|
| 2,444,860 | 7/1948 | Summer | 101/127.1 X |
| 2,487,542 | 11/1949 | Haff | 33/614 X |
| 3,067,666 | 12/1962 | Coffman | 33/617 X |
| 3,513,775 | 5/1970 | Guthrie | 101/129 |
| 4,463,673 | 8/1984 | Moore | 101/DIG. 36 X |
| 4,628,815 | 12/1986 | Van Kanegan | 101/DIG. 36 X |
| 4,641,577 | 2/1987 | Sweeny | 101/DIG. 36 X |
| 4,738,909 | 4/1988 | Jennings | 101/126 X |

*Primary Examiner*—Edgar S. Burr
*Assistant Examiner*—Moshe I. Cohen
*Attorney, Agent, or Firm*—Richard C. Conover

[57] ABSTRACT

This invention relates to an aligning structure for aligning pin-receiving holes on a screen frame used in screen printing relative to upright pins mounted on a pin bar. The aligning structure, includes a pair of plates clamped on the frame. A first plate has an upright-pin-receiving hole to slidably receive the upright pin. A second plate has an upright-pin-receiving hole substantially larger than the upright pin. If the upright pin is received by both upright-pin-receiving holes and the clamp is loosened, the two plates can slide relative to each other to reposition the upright-pin-receiving hole relative to the screen frame. Retightening the clamp maintains the new alignment.

1 Claim, 1 Drawing Sheet

ADJUSTABLE PIN GUIDE FOR USE IN SCREEN PRINTING

BACKGROUND OF THE INVENTION

This invention relates to an adjustable pin guide for use in screen printing, and more particularly to structure incorporated in a screen frame for adjusting the frame relative to an upright pin of a conventional pin bar.

In multi-color screen printing, it is necessary that each of the color screens be properly aligned with respect to one another, and also the screens in a particular sequence be aligned with respect to a printing platen so as to print a clear, high quality image.

For screen printing of garments, frames are often used to hold the screens, each frame holding a particular screen associated with one printing color. The frames thus aid an operator in handling the screens during the printing process. However, adjusting the frames relative to one another if the frames become warped, or the screens shift in the frames in some manner during their useful life remains a problem.

Several prior art patents describe mechanisms for registering a series of screens at the time they are made, but these patents do not recognize the problem of being able to later adjust a screen with respect to either upright pins, a worktable, or with other screens in a sequence. For instance, U.S. Pat. No. 2,444,860 to Summer, and U.S. Pat. No. 3,513,775 to Guthrie, illustrate mechanisms for aligning screens in original registration, but these devices provide no means for later adjusting the screens if they become warped or shifted in some manner. Presently, if one of the frames holding a screen is not aligned with the rest of the frames in a sequence, the associated screen is usually destroyed and a new screen is fixed on a frame and prepared in proper registration with the series. This is a time consuming and expensive process.

There are alignment mechanisms known which permit frames to be adjusted along one axis. For instance, U.S. Pat. No. 4,738,909 to Jennings illustrates a device for registering a screen with a plurality of upright registration pins mounted on a registration plate also known as a pin bar. With this device, which clamps to the edge of a frame, realignment movement is restricted to movement in a direction parallel with an edge of the frame. Rotating the frame, or moving the frame in direction perpendicular to the clamped edge, are adjustment movements that cannot be accommodated with the structure described in this patent.

There remains a clear need to be able to move a screen frame in any planar direction in order to adjust the single frame relative to a sequence of frames in a particular series, or to adjust a frame relative to the upright pins on a pin bar, layout board, or screen printing machine.

SUMMARY OF INVENTION

The present invention relates to an aligning structure on a screen frame which permits a user to re-align at any time the aligning holes of the frame with the upright pins of a pin bar, and thus, easily re-register a frame once it loses registration with the other frames in a sequence.

The structure according to the present invention includes a pair of plates, one of which has an upright-pin-receiving hole sized to slidably receive the upright pin of a pin bar and a bolt-receiving bore sized to be substantially larger in cross section than the cross-sectional area of a clamping bolt to be received. The clamping bolt is used to releasably clamp the structure together in a selected position after proper alignment has been achieved.

A second plate has an upright-pin-receiving bore sized to be substantially larger in cross section than the corresponding cross-sectional area of the upright pin of the pin bar and a bolt-receiving bore sized to slidably receive the clamping bolt. Further, the frame has a bolt-receiving bore therethrough for slidably receiving the clamping bolt and also a pin-receiving recess substantially larger in cross section than the corresponding cross-sectional area of the upright pin. An upright pin of the pin bar is positioned within the pin-receiving bores of the first and second plates and within the pin-receiving recess of the frame. When it is desired to change the position of the frame with respect to an upright pin, a nut on the clamping bolt is loosened and the frame manually positioned in proper position relative to the upright pin. The nut on the clamping bolt is then tightened to secure the frame in this position.

With this structure, a user can easily adjust the frame with respect to the upright pin of a pin bar thereby enabling a user to reuse screens even when the frame becomes warped or the image otherwise becomes shifted.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF PREFERRED EMBODIMENT

Figure 1:
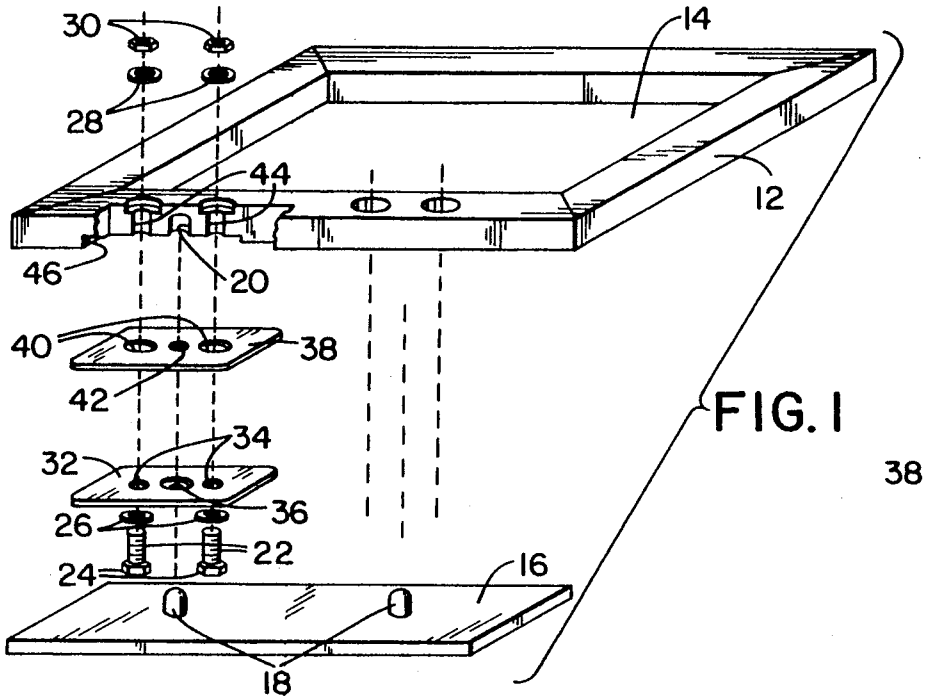
FIG. 1 is an exploded perspective view of a screen frame with portions broken away showing the adjustable pin guide according to the present invention.

A preferred embodiment of the present invention is shown in FIG. 1. In this FIGURE, a frame 12 is shown having a screen 14 stretched across the frame elements. This screen is used in screen printing. Further, a pin bar 16 is shown having upright pins 18. In the embodiment shown in FIG. 1, a pair of pins 18 are shown. However, it should be understood that there other types of pin bars which could be used such as a single pin having a non-circular configuration, for example, a diamond. All such other pin registration systems are considered to be within the scope of the present invention. This upright pin is received by an enlarged pin recess 20 located in frame 12.

Figure 3:
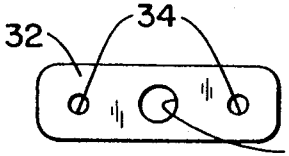
FIG. 3 is a top view of a second plate as shown in FIG. 1.

A pair of clamping bolts 22 are shown which have heads 24 and associated washers 26 and 28 and nuts 30 which are threaded on bolts 22. A first aligning plate 32 is shown in FIGS. 1 and 3. This plate 32 includes a pair of clamping bolt-receiving holes 34 which are sized to slidably receive the clamping bolts 22. This aligning plate 32 further has a pin-receiving bore 36 which is sized to have a cross-sectional area substantially larger than the corresponding cross-sectional area of upright pin 18.

Figure 2:
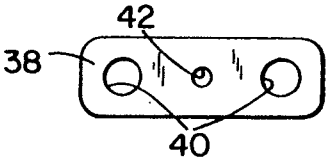
FIG. 2 is a top view of a first plate shown in FIG. 1.
Figure 4:
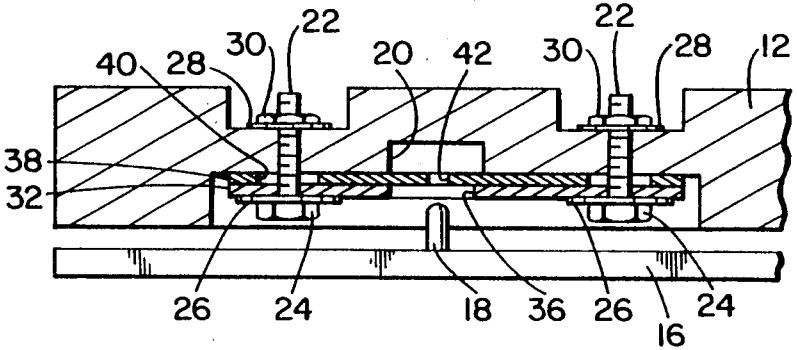
FIG. 4 is a perspective view of the assembled screen frame with portions broken away, positioned above a pin bar.

A second aligning plate 38 is also shown in FIGS. 1 and 2. The second aligning plate 38 includes a pair of bolt-receiving holes 40 which are sized to be substantially larger in cross section than the corresponding cross section of the clamping bolts 22, and further includes a pin-receiving bore 42 which has a cross-sectional area sized to slidably receive the upright pin 18.

The frame 12 further includes a pair of bolt-receiving bores 44 which are sized to have a cross section to slidably receive the clamping bolts 22. The frame is further provided with a recess 46 for receiving the first aligning plate and second aligning plate. In a preferred embodiment and as shown in FIG. 3, this recess is sized to insure that the first and second aligning plates and the head of the clamping bolts 22 do not protrude from the bottom of the frame.

To assemble the aligning structure according to the present invention, the first aligning plate and the second aligning plate are positioned in the recess 46 of the frame 12. The two clamping bolts are then positioned through the bolt-receiving bores 34, the bolt-receiving bores 40 and the frame bolt-receiving bores 44 as shown in FIG. 1. The frame 12 with the first aligning plate 32 and second aligning plate 38 mounted thereto is then positioned on the pin bar 16 so that the upright pin 18 extends through the pin-receiving bore 36, the pin-receiving bore 42 and into pin recess 20 in frame 12. The frame is then moved in any direction in a horizontal plane as shown in FIG. 1 for the image on screen 14 to be aligned with a positive image mounted on a layout board (not shown). Once this alignment occurs, the nuts 30 are then screwed tightly onto clamping bolts 22 to secure the first aligning plate and the second aligning plate to the frame 12. When this occurs, the frame 12 is properly aligned with the upright pin 18 of pin bar 16.

Whenever a frame with the negative screen thereon becomes out of registration with upright pin 18, the nuts 30 can be loosened and the frame adjusted to re-register the screen 14 with respect to the upright pin 18.

Accordingly, the present invention provides a simple yet effective method and apparatus for greatly facilitating the accurate re-registration of screens with respect to registration pins on pin bars. It should be recognized that various other clamping means may be available for clamping the aligning plates to the screen frame and that the embodiment described herein is only a preferred embodiment.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as described by the following claims:

I claim:

1. An adjustable pin-receiving guide for use with a pin bar having an upright pin when printing from screens held by a frame, the adjustable pin-receiving guide comprising:

a clamping bolt for threadably receiving a clamping nut;

a first plate having an upright pin-receiving bore sized to slidably receive the upright pin and a bolt-receiving bore sized to be substantially larger in cross section than the corresponding cross-sectional area of the clamping bolt to be received;

a second plate having an upright pin-receiving bore sized to be substantially larger in cross section than the corresponding cross-sectional area of the upright pin and a bolt-receiving bore sized to slidably receive the clamping bolt;

the frame having a bolt-receiving bore therethrough for slidably receiving the clamping bolt and having a pin-receiving recess substantially larger in cross section than the corresponding cross-sectional area of the upright pin;

the frame further including a recess sized to receive the first plate;

the upright pin positioned within the pin-receiving bores of the first and second plates and within the pin-receiving recess of the frame;

the clamping bolt being positioned to extend through the bolt-receiving bore of the frame, the bolt-receiving bore of the first plate and the bolt-receiving bore of the second plate;

the clamping bolt having a head larger in cross-sectional area than the bolt-receiving hole of the second plate; and the clamping nut being larger in cross section than the cross-sectional area of the bolt-receiving hole of the frame.

* * * * *